US009239199B2

(12) United States Patent
Martin et al.

(10) Patent No.: US 9,239,199 B2
(45) Date of Patent: Jan. 19, 2016

(54) APPARATUS, SYSTEMS AND METHODS FOR LOADING MOONCLIPS

(71) Applicant: The Revolver Supply Company, LLC, Mimbres, NM (US)

(72) Inventors: George Martin, Mibres, NM (US); Marcia Winters, Mimbres, NM (US)

(73) Assignee: The Revolver Supply Co., LLC, Mimbres, MN (US)

( * ) Notice: Subject to any disclaimer, the term of this patent is extended or adjusted under 35 U.S.C. 154(b) by 0 days.

(21) Appl. No.: 14/824,306

(22) Filed: Aug. 12, 2015

(65) Prior Publication Data

US 2015/0345883 A1 Dec. 3, 2015

Related U.S. Application Data

(62) Division of application No. 13/870,098, filed on Apr. 25, 2013, now Pat. No. 9,121,653.

(60) Provisional application No. 61/637,949, filed on Apr. 25, 2012.

(51) Int. Cl.
*F41A 9/85* (2006.01)

(52) U.S. Cl.
CPC ..... *F41A 9/85* (2013.01)

(58) Field of Classification Search
CPC ..... F41A 9/82; F41A 9/83; F41A 9/84; F41A 9/85; F41C 9/085
USPC ..... 42/87–89, 108
See application file for complete search history.

(56) References Cited

U.S. PATENT DOCUMENTS

| | | | | | |
|---|---|---|---|---|---|
| 667,351 | A * | 2/1901 | Wagner | F41A 9/85 | 42/89 |
| 684,752 | A * | 10/1901 | Garfield | F41A 9/85 | 42/89 |
| 4,507,889 | A * | 4/1985 | Allen | F41A 9/85 | 42/89 |
| 4,535,558 | A * | 8/1985 | Benesh | F41A 9/85 | 42/89 |
| 4,796,371 | A * | 1/1989 | Daniels | F41A 9/85 | 42/89 |
| 5,083,393 | A * | 1/1992 | Smydas | F41A 9/85 | 42/89 |
| 6,665,974 | B1 * | 12/2003 | Anderson | F41A 9/83 | 42/89 |
| 2014/0082984 | A1 * | 3/2014 | Kent | F41A 9/83 | 42/88 |

* cited by examiner

*Primary Examiner* — Joshua Freeman
(74) *Attorney, Agent, or Firm* — Scherrer Patent & Trademark Law, P.C.; Stephen T. Scherrer; Monique A. Morneault

(57) ABSTRACT

The present invention relates to apparatus, systems and methods for loading moonclips. Specifically, the present invention provides apparatus, systems and methods that provide for the automatic loading of moonclips with rounds, to be used with handguns having revolver cylinders. More specifically, the present invention provides apparatus, systems and methods that allow for quick, easy and efficient loading of moonclips by holding a moonclip and pressing a round into a round receiving receptacle of the moonclip.

8 Claims, 7 Drawing Sheets

—PRIOR ART—

—PRIOR ART—

—PRIOR ART—

—PRIOR ART—

APPARATUS, SYSTEMS AND METHODS FOR LOADING MOONCLIPS

The present invention claims priority to U.S. patent application Ser. No. 13/870,098, titled "Apparatus, Systems and Methods for Loading Moonclips," filed Apr. 25, 2013, which claims priority under 35 U.S.C. 119 to U.S. provisional patent application No. 61/637,949, entitled "Apparatus, Systems and Methods for Loading Moonclips," filed Apr. 25, 2012, which is incorporated herein by reference in its entirety.

TECHNICAL FIELD

The present invention relates to apparatus, systems and methods for loading moonclips. Specifically, the present invention provides apparatus, systems and methods that provide for the automatic loading of moonclips with rounds, to be used with handguns having revolver cylinders. More specifically, the present invention provides apparatus, systems and methods that allow for quick, easy and efficient loading of moonclips by holding a moonclip and pressing a round into a round receiving receptacle of the moonclip.

BACKGROUND

It is, of course, generally known to utilize revolvers as handguns for shooting, whether for sport, hunting, protection, military purposes, or the like. Indeed, the revolver cylinder handgun has been in use since about 1818, when the first revolver cylinder handgun was invented by Elisha Collier, and has been improved upon ever since. The first cartridge revolvers were made in 1856 by Smith & Wesson as a "revolving gun," which has been shortened to, simply, "revolver."

The revolver, in operation, works, generally, as follows: as the user cocks a hammer, a cylinder revolves to align a chamber and round with the hammer and the barrel of the gun. The hammer-cocking occurs either directly (via the shooter pulling it back) or indirectly (via the first portion of the trigger pull in double-action revolvers). In modern revolvers, the revolving cylinder typically chambers five or six rounds, but some models may hold 10 rounds or more. Although most revolvers are handguns, other firearms may also have revolving cylinders, such as rifles.

The moonclip is a device that allows for relatively easy loading of rounds into and unloading of spent casings out from the revolving cylinders of revolvers. Indeed, to typically load a revolving cylinder with rounds, the cylinder is typically rotated out of alignment from the firing pin and the barrel exposing the chambers within which the rounds are placed. Each round may be placed individually into each of the exposed chambers. Upon filling, the cylinder is rotated back in alignment with the firing pin and the barrel. The revolver is then typically ready for discharge. The moonclip was developed to hold all of the rounds that may be added to a cylinder of a revolver as one complete unit. Moonclips may either hold an entire cylinder's worth of cartridges together (full moon clip), half a cylinder (half-moon clip), or just two neighboring cartridges.

FIG. 1 illustrates a prior art round or cartridge 10 that may be fired from a revolver or other firearm. The round or cartridge 10 may include a casing 12 filling with propellant (not shown), and a bullet 14. At the base of the round may be a primer (not shown) that may be struck by a hammer of a gun to ignite the propellant, thereby forcefully expelling the bullet from the casing. The casing may further have a groove 16 running the circumference of the casing that may aid the casing in loading the round or cartridge 10 into a chamber of a revolver.

FIG. 2 illustrates a prior art moonclip 20. The moonclip 20 may be a roughly circular metal frame 22 having a plurality of round receiving receptacles 24 for holding the rounds on the moonclip 20. The round receiving receptacles 24 hold the rounds by engaging with the groove 16 (as illustrated in FIG. 1). FIG. 3 shows the moonclip 20 partially filled with a plurality of rounds. Two of the round receiving receptacles are unfilled. Thus, the moonclip 20, when fully filled with rounds, may be inserted into the cylinder of the revolver, as illustrated in FIG. 4. The cylinder may then be closed, with the moonclip holding the rounds within the chambers of the cylinder. The revolver may then be ready for discharging the bullets therefrom. In general, moonclips may have open berths for a plurality of rounds or cartridges, and the number of spaces for holding rounds or cartridges is dependent on the number of chambers of the firearm for holding the rounds. For example, moonclips may be utilized for 5-shot firearms, 6-short firearms, or any other number apparent to one of ordinary skill in the art. Moreover, while moonclips are typically know for engaging the groove at the base of a round or cartridges, moonclips may also be used with so-called "rim-fire cartridges"—those lacking a groove for engaging a moonclip, such as, for example, the 0.22 long rifle.

Moonclips aid in helping users of the revolver load the cylinder with rounds. The military first required moonclips to hold rimless 45 ACP cartridges, or rounds, in the Model 1917 revolver. Over time, the moonclips fell out of favor until Smith & Wesson, in the 1970s and 1980s, introduced the Model 625 45 ACP revolver. This revolver became very popular and in a few years several new shooting sports were born based on the revolver, specifically combat shooting, action shooting and bowling pin shooting. Each of these sports requires that the competitor make reloads during the course of fire. Thus, moonclips became necessary to easily, quickly and efficiently reload the revolvers.

In practice, the moonclips operate by allowing the entirety of rounds that may fill a cylinder to be added to the cylinder at the same time as one unit, saving significant time. Moreover, all of the spent casings may be removed when the cylinder is fully discharged, again saving significant time in emptying the cylinder of the casings.

While the speed and ease of loading and emptying of rounds and casings into and out from the cylinder may be significantly increased, the moonclips themselves must be loaded. However, it is often difficult and time-consuming to load the moonclips and thereby ready the moonclips for use in the revolver.

Moonclip tools are known to aid in the loading of rounds onto moonclips for their use in revolvers. Various types of moonclip tools are known. Examples of moonclip tools include the "Moonsetter™", a tool generally in the shape of pliers having an arbor on one jaw and a holder for a round on the other. The Moonsetter™ is difficult to operate: a user must balance a round on the one jaw, and manually position the moonclip on the other to receive the round.

Another moonclip tool, marketed as "The Original Moonclip Tool" utilizes a base having a movable arbor and a spring-loaded lever with notches therein. The moonclip may be placed on the arbor and a round may be placed in position between the lever and the moonclip. The moonclip is typically disposed so that a small space is provided between the round receiving receptacles of the moonclip and the base. Therefore, when a round is disposed into a round receiving receptacle, as disclosed below, the round receiving receptacle of the moonclip tool may be in the proper position to receive the groove of the casing of the round.

A round receiving receptacle of the moonclip is then manually rotated to align with the round, and the spring-loaded lever is moved to push the round into the round receiving receptacle of the moonclip. As noted above, the moonclip may be disposed at the proper position for the round receiving receptacle to engage the groove of the round, firmly holding the round in place within the round receiving receptacle.

Another moonclip tool is known as the "Remooner™", which provides a platform for holding a moonclip on an arbor, and a trigger for pushing rounds onto a moonclip. However, the Remooner™ does not provide the leverage necessary for generating the sufficient force required to clip rounds onto certain moonclips, such as 45 ACP or other like rounds, since pushing a round onto a moonclip is merely limited to an user's hand strength as the user squeezes the Remooner™. Moreover, the Remooner™ is awkward to handle and utilize, since the moonclips and rounds must be placed in a rear position on the apparatus. Finally, the Remooner™ is not ergonomic in that an individual must hold the apparatus at an awkward angle, creating tension in the hands and wrist and decreasing the force from the hands as a user utilizes the apparatus.

It can be difficult to utilize existing moonclip tools to load rounds into a moonclip. Specifically, to properly hold most existing moonclip tools, one must typically tilt the moonclip tool on its side and manually place a round for receipt in alignment with the round receiving receptacle of the moonclip. By tilting the moonclip tool, the round itself may be difficult to align, and if not held properly, the round may fall off the moonclip tool before being received by the moonclip.

A need, therefore, exists for apparatus, systems and methods for loading rounds to moonclips. Specifically, a need exists for apparatus, systems and methods for quickly, easily and efficiently clipping rounds onto a moonclip so that the same may be used for loading into a revolver.

Moreover, a need exists for apparatus, systems and methods for loading rounds to moonclips that provides stability for the moonclips and the rounds added thereto. Moreover, a need exists for apparatus, systems and methods for loading rounds to moonclips that allows rounds to be easily aligned and pushed onto the moonclips.

Further, a need exists for apparatus, systems and methods for loading rounds to moonclips that offers significant automation so that a user may easily accomplish the loading of the moonclips. Still further, a need exists for apparatus, systems and methods for loading rounds to moonclips that allows automatic advancement and alignment of the rounds as each round is loaded onto a moonclip.

SUMMARY OF THE INVENTION

The present invention relates to apparatus, systems and methods for loading moonclips. Specifically, the present invention provides apparatus, systems and methods that provide for the automatic loading of moonclips with rounds, to be used with handguns having revolver cylinders. More specifically, the present invention provides apparatus, systems and methods that allow for quick, easy and efficient loading of moonclips by holding a moonclip and pressing a round into a round receiving receptacle of the moonclip.

To this end, in an embodiment of the present invention, a moonclip tool is provided. The moonclip tool comprises a base and a handle, wherein the base and the handle are integrally formed together to form an L-shape, with a flat platform portion on the top of the base. The handle may further have a trigger lever and pivot point, wherein the trigger lever may extend partially from the handle, and engage with a spring that forcefully presses thereagainst and resists pushing of the trigger lever towards the handle. The trigger lever is interconnected with an arm located on the flat platform portion, the arm movable longitudinally on the flat platform portion. The flat platform portion further comprises an arbor for holding a moonclip, whereby a round placed adjacent the arm may be forcefully pressed into the moonclip by pressing the trigger lever towards the handle.

In an embodiment of the present invention, an apparatus for loading rounds into a moonclip is provided. The apparatus comprises a base, wherein the base has a flat platform portion on the top of the base; a handle, wherein the base and the handle are integrally formed together to form an L-shape; a trigger lever disposed within the handle, wherein the trigger lever has a pivot point, and further wherein the trigger lever extends partially from the handle; an arm located on the flat platform portion interconnected with the trigger lever, wherein the arm is movable longitudinally on the flat platform portion; an arbor for holding a moonclip disposed on the flat platform portion; and an advancement mechanism that rotates the moonclip.

In an embodiment, the apparatus further comprises a spring disposed within the handle that forcefully presses thereagainst and resists pushing of the trigger lever towards the handle.

In an embodiment, the advancement mechanism comprises: a gear disposed beneath the arbor, wherein the gear rotates independent of the arbor in a first direction and rotates in conjunction with the arbor in a second direction; and a rack attached to the arm that engages the gear.

In an embodiment, the apparatus further comprises: a plurality of notches disposed on the arbor; and a brace disposed within the base that contacts the plurality of notches, wherein the brace prevents rotation of the arbor in the first direction and permits rotation of the arbor in the second direction.

In an embodiment, the apparatus further comprises: a containment unit that holds additional rounds.

In an embodiment, the arm is disposed on a track.

In an embodiment, the moonclip is freely rotatable about the arbor.

In an embodiment, the moonclip rotates in conjunction with the arbor.

In an alternate embodiment of the present invention, an apparatus for loading rounds into a moonclip is provided. The apparatus comprises: a base, wherein the base is divided into a plurality of sections; a rotatable disc, wherein the rotatable disc is disposed on top of the base; a plurality of arms, wherein the plurality of arms are disposed between the plurality of sections; a plurality of slots disposed within the rotatable disc; and an arbor for holding a moonclip.

In an embodiment, a plurality of handles is disposed on the rotatable disc.

In an embodiment, the slots are inwardly angled.

In an embodiment, the arms are connected to the disc by a plurality of bolts, wherein the bolts are disposed within the plurality of slots within the disc.

In an embodiment, the plurality of arms each comprises a chamber for inserting a round.

In an embodiment, a plurality of slots is disposed within the base below the plurality of arms.

In an embodiment, the base is circular.

In an embodiment, the moonclip fits snug on the arbor.

In an alternate embodiment of the present invention, a method for loading rounds into a moonclip is provided. The method comprises the steps of: providing an apparatus for loading rounds into a moonclip, the apparatus comprising a base, an arbor for holding a moonclip disposed on the base, at least one arm disposed within the base, wherein the at least one arm moves a round into the moonclip, and a trigger mechanism that advances the at least one arm towards the moonclip; placing a moonclip on the arbor; placing at least one round adjacent the at least one arm; using the trigger mechanism to advance the at least one arm towards the moonclip; and inserting the at least one round into the moonclip.

In an embodiment, the method further comprises the steps of: providing a trigger and a handle, wherein the trigger and handle comprise the trigger mechanism; and moving the trigger towards the handle about a pivot point, wherein moving the trigger towards the handle advances the at least one arm towards the moonclip.

In an embodiment, the method further comprises the steps of: providing a rotatable disc and at least one bolt connected to the at least one arm, wherein the at least one bolt is disposed within at least one slot within the rotatable disc, and further wherein the rotatable disc and the at least one bolt comprise the trigger mechanism; and rotating the disc, wherein as the disc rotates the at least one bolt follows the at least one slot and advances the at least one arm towards the moonclip.

In an embodiment, the method further comprises the steps of: rotating the moonclip; and removing the moonclip from the arbor.

It is, therefore, an advantage and objective of the present invention to provide apparatus, systems and methods for loading rounds to moonclips.

Specifically, it is an advantage and objective of the present invention to provide apparatus, systems and methods for quickly, easily and efficiently clipping rounds onto a moonclip so that the same may be used for loading into a revolver.

Moreover, it is an advantage and objective of the present invention to provide apparatus, systems and methods for loading rounds to moonclips that provides stability for the moonclips and the rounds added thereto.

And, it is an advantage and objective of the present invention to provide apparatus, systems and methods for loading rounds to moonclips that allows rounds to be easily aligned and pushed onto the moonclips.

Further, it is an advantage and objective of the present invention to provide apparatus, systems and methods for loading rounds to moonclips that offers significant automation so that a user may easily accomplish the loading of the moonclips.

Still further, it is an advantage and objective of the present invention to provide apparatus, systems and methods for loading rounds to moonclips that allows automatic advancement and alignment of the rounds as each round is loaded onto a moonclip.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to apparatus, systems and methods for loading moonclips. Specifically, the present invention provides apparatus, systems and methods that provide for the automatic loading of moonclips with rounds, to be used with handguns having revolver cylinders. More specifically, the present invention provides apparatus, systems and methods that allow for quick, easy and efficient loading of moonclips by holding a moonclip and pressing a round into a round receiving receptacle of the moonclip.

While the present invention is specifically described as a hand-held device, in that a user may utilize the present invention using one or both of his or her hands, it should be noted that the invention disclosed herein may be utilized as a part of a machine or larger apparatus that may automatically feed rounds onto the present invention and automatically push the rounds onto the moonclips.

Figure 1:
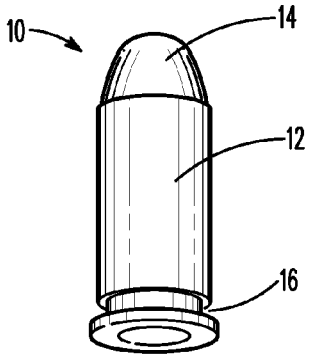
FIG. 1 illustrates a prior art view of a round or cartridge.
Figure 2:
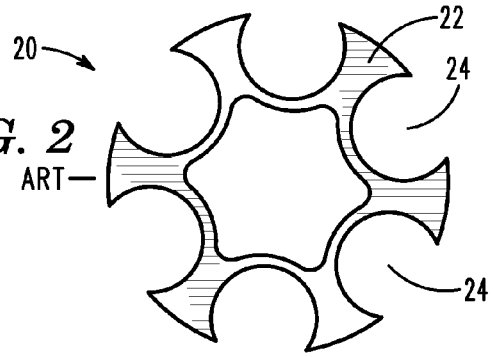
FIG. 2 illustrates a prior art view of a moonclip.
Figure 3:
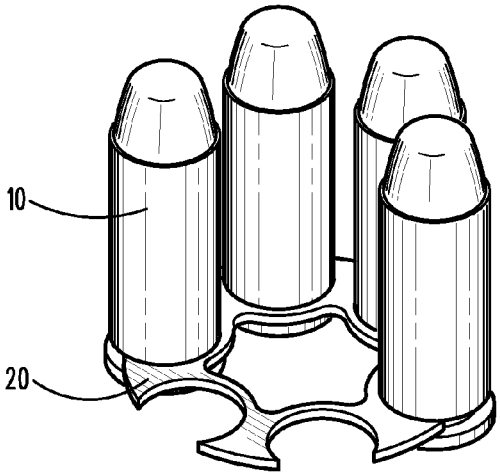
FIG. 3 illustrates a prior art perspective view of a moonclip partially filled with rounds or cartridges.
Figure 4:
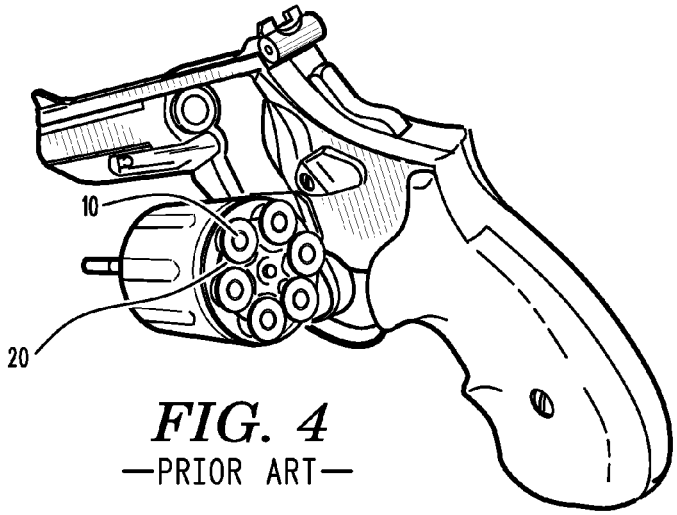
FIG. 4 illustrates a prior art perspective view of a moonclip filled with rounds or cartridges disposed in a cylinder of a revolver for discharging of the same with the revolver.

Now referring to the figures, wherein like numerals refer to like parts, FIGS. 1-4 illustrate prior art relating to the present invention. Specifically, as discussed in more detail above, FIG. 1 illustrates a round 10, otherwise known as a cartridge, for discharging from a revolver. FIG. 2 illustrates a prior art moonclip 20 for holding rounds in round receiving receptacles 24 on a frame 22, as illustrated in more detail in FIG. 3. FIG. 4 illustrates the use of a moonclip in a cylinder of a revolver, holding rounds within the respective chambers, allowing the cylinder to be easily loaded and unloaded. Of course, any type of moonclip may be loaded with rounds by the present invention, including standard circular moonclips, half-moonclips, dual moonclips (holding two rounds so that a plurality of gauge rounds may be utilized by a firearm), or any other like moonclip. Moreover, the moonclips as described herein may be utilized with any firearm that may be utilized to hold the moonclips, such as the side-load revolver, shown in FIG. 4, or a break-top revolver (not shown), and the present invention should not be limited as described herein.

Figure 5:
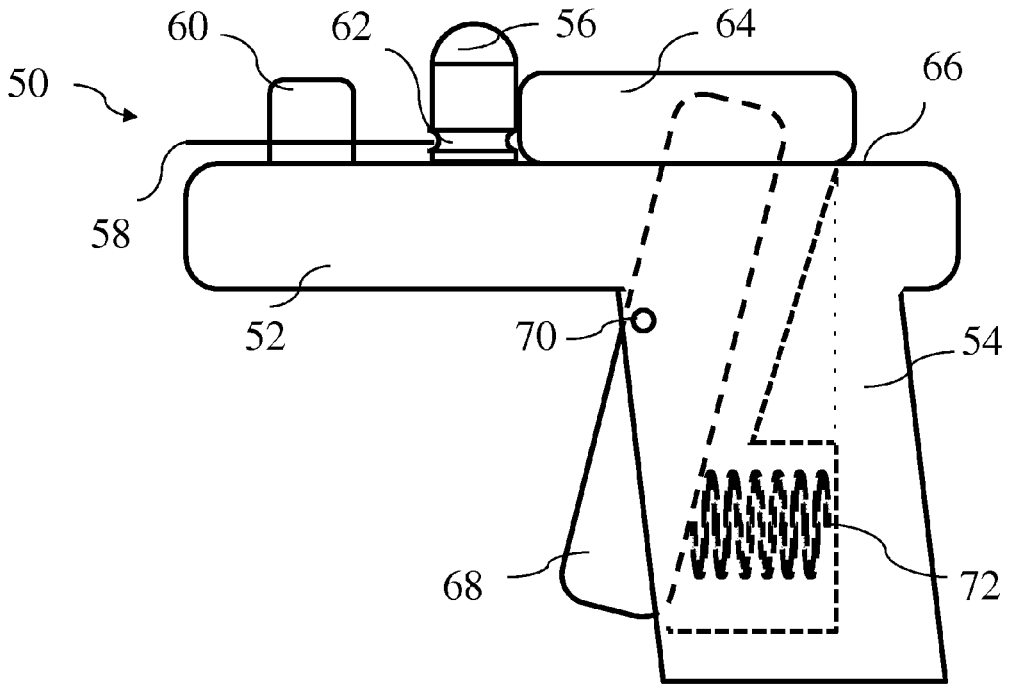
FIG. 5 illustrates a side view of a moonclip tool in an embodiment of the present invention.

FIG. 5 illustrates a moonclip tool 50 of the present invention. The moonclip tool 50 comprises a base 52 and a handle 54 integrally connected to the base 52, forming, generally, an L-shaped apparatus for aiding in the loading of a round 56 onto a moonclip 58. The moonclip 58 sits upon an arbor 60 that may be shaped in such a manner to allow the moonclip 58 to rest a distance above the base 52, and in alignment with a groove 62 on the round 56. The moonclip tool 50 further has an arm 64 disposed on a top surface 66 of the base 52 that may be linked to a trigger lever 68 that may be disposed within the handle 54, extending upwardly and linked with the arm 64. The trigger lever 68 may be pivoted at pivot point 70. Spring 72 may be disposed within handle 54, and may engage the trigger lever 68.

Figure 6:
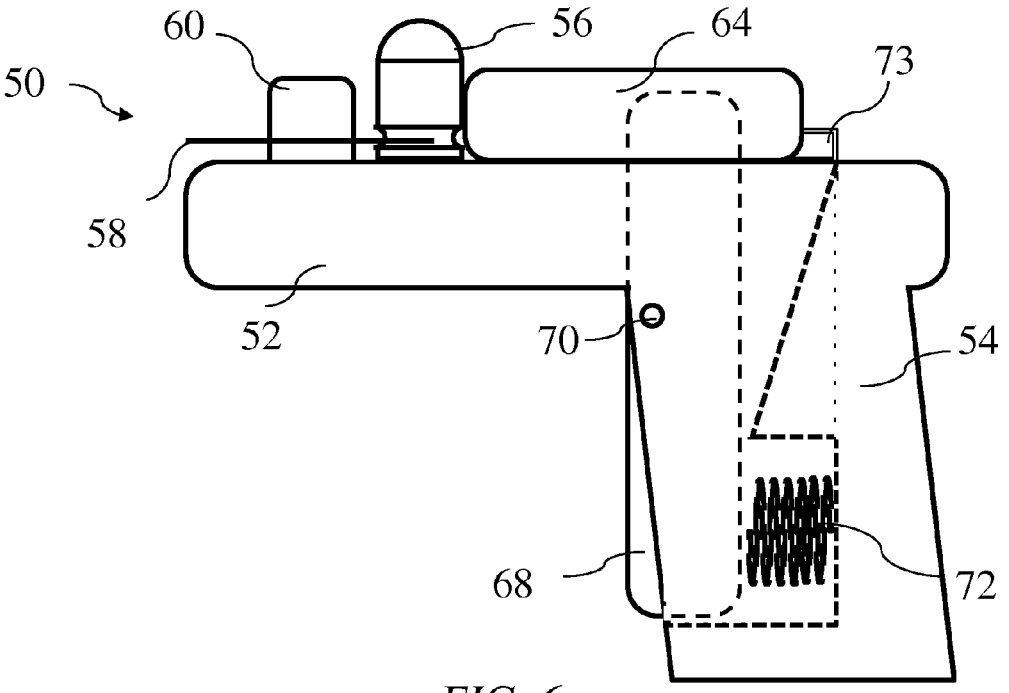
FIG. 6 illustrates a side view of a moonclip tool in operation pressing a round into a moonclip in an embodiment of the present invention.
Figure 7:
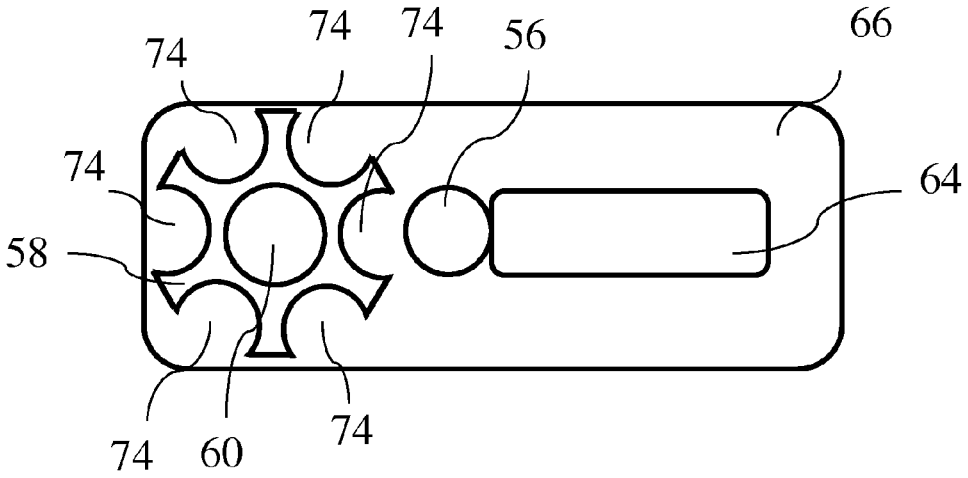
FIG. 7 illustrates a top view of a moonclip tool in an embodiment of the present invention.
Figure 8:
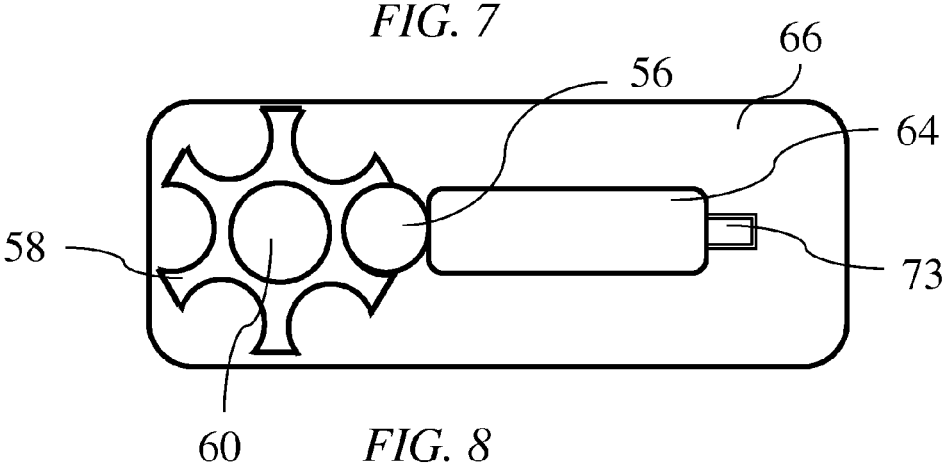
FIG. 8 illustrates a top view of a moonclip tool in operation pressing a round into a moonclip in an embodiment of the present invention.

FIG. 7 illustrates a top view of the moonclip tool 50. As illustrated in FIG. 7, the round 56 may be placed on the top surface 66 of the base 52 in alignment with a round receiving receptacle 74 of the moonclip 58 that may be placed on the arbor 60. Upon squeezing trigger lever 68 inwardly toward handle 54, the trigger lever 68 may move arm 64 that may be placed on a track 73, as illustrated in FIGS. 7 and 8, allowing for movement of the arm 64 longitudinally on the surface 66 of the base 52. Thus, arm 64 may push round 56 into one of the round receiving receptacles 74 contained on the moonclip 58. FIG. 6 illustrates the trigger lever 68 pressed inwardly, engaging arm 64 and moving arm 64 to push round 56 into moonclip 58. FIG. 8 illustrates a top view, showing arm 64 having pushed round 56 into round receiving receptacle 74 of moonclip 58.

Because the trigger lever 68 moves arcuately when squeezed by a user, a user may find further comfort and leverage if the trigger lever 68 may be shaped to include, in addition to, or integrally formed with the trigger lever 68, a block or linear portion that my allow the user to more easily wrap his or her fingers therearound for utilizing the same, rather than gripping on an angle, as shown in FIG. 5. Therefore, by utilizing a block interconnected with or integrally formed with the trigger lever 68, the user may utilize his or her entire hand to provide leverage on the trigger lever 68 to more effectively push a round onto a moonclip, as described herein.

Moreover, as illustrated in FIGS. 5 and 6, the handle 54 may be disposed angularly with respect to base 52 so that the moonclip tool 50 may be held more effectively in a neutral position in a user's hand, thereby providing better squeezing power from the user's hand as the user squeezes trigger lever 68 to push a round 56 onto the moonclip 58, thereby minimizing or eliminating any stress or strain that may be placed on a user's hand or wrist. Moreover, the handle and/or the trigger lever 68, or a block interconnected therewith or integrally formed therewith (as described above), may have a "hand shape" formed therein to provide a more ergonomic and comfortable grip by the user when holding the moonclip tool 50.

Spring 72 has sufficient resistance against the pressing inwardly of the trigger lever 68 to push trigger lever 68 back to its starting position, thereby moving arm 64 rearwardly and away from moonclip 58. Thus, additional rounds may be placed individually into position in alignment with round receiving receptacles 74 on moonclip 58 to be pressed and engaged into moonclip 58.

In the embodiment shown in FIGS. 5-8, a user of the moonclip tool 50 manually places round 56 into position adjacent arm 64 and manually rotates moonclip 58 so that an open round receiving receptacle 74 may be in alignment with the round 56. However, other embodiments of the present invention include a mechanism whereby the moonclip 58 automatically advances when the trigger lever 68 is pressed inwardly toward handle 54, or when spring 72 pushes trigger lever 68 back into its starting position, without requiring manual advancement thereof by the user. Therefore, a user of the moonclip tool 50 would not be required to manually advance the moonclip to its next open round receiving receptacle.

Figure 9:
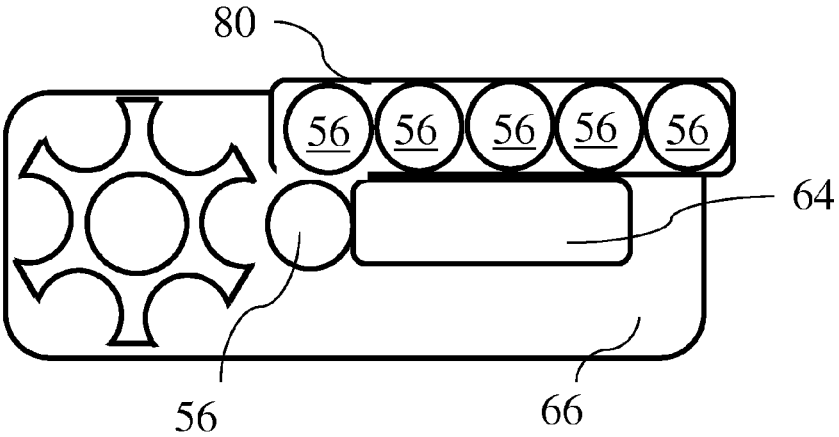
FIG. 9 illustrates a top view of a moonclip tool with a round containment unit holding a plurality of rounds in an embodiment of the present invention.

In addition, or in the alternative, a round containment unit 80 may be utilized that may hold a plurality of rounds 56, as illustrated in FIG. 9. The round containment unit 80 may hold the plurality of rounds 56, and may automatically feed one of the rounds into position adjacent arm 64 to be pressed into moonclip tool 58. Specifically, a round may automatically advance from round containment unit 80 into proper position for pressing into moonclip tool 58. A mechanism (not shown) may be interconnected with the trigger lever 68 to advance the round from the round containment unit 80 into the proper position for pressing into the moonclip 58. For example, the round may be automatically placed into position adjacent arm 64 when spring 72 pushes trigger lever 68 back to the starting position. The round containment unit 80 may be integrally formed with the surface 66 of the moonclip tool 50, or may be detachable and attachable thereto, as needed.

Although the round containment unit 80 is shown as a linear unit for holding rounds therein for advancing and loading into moonclips, it should be noted that the round containment unit may be any shape that may allow a plurality of rounds to be fed into position for clipping into moonclips, as described herein, such as round or barrel-shaped, tube-shaped or the like. Moreover, while the round containment unit 80 is shown in a particular location, as illustrated in FIG. 9, it should be noted that the round containment unit may be place in any location apparent to one of ordinary skill in the art. For example, the round containment unit holding a plurality of rounds for feeding into position may be provided above the surface 66 and/or the arm 64, and may feed a round downwardly into position on the surface 66 for clipping into the moonclip 58, instead of from the side thereof as described herein.

Alternatively, both the rounds 56 from the round containment unit 80 and the moonclip 58 may automatically advance after pressing of a round into the moonclip. Specifically, upon pressing a round into moonclip 58, a mechanism (not shown) within base 52 may advance both another round into position adjacent the arm 64 from the round containment unit 80, and, at the same time, or very nearly close in time, may advance the moonclip 58, thereby automatically providing another round in alignment with an open round receiving receptacle 74 of the moonclip 58. Thus, a user may not be required to manually place a round in position and/or advance the moonclip to align an open round receiving receptacle with the round.

The automatic advancement of the moonclip 58 and/or the automatic advancement of a round into position for clipping onto the moonclip 58 may be accomplished mechanically, as described herein, or may be electronically controlled, such that the trigger lever 68 may engage an electronic control for electronically advancing the moonclip 58 and/or the round from the round containment unit 80. Moreover, these may further be accomplished via a combination of mechanical and electrical means, and may be driven via battery power, solar power, or any other power source apparent to one of ordinary skill in the art. Indeed, the pushing of the arm 64 may also be accomplished electronically instead of through the squeezing of the trigger lever 68, and the invention should not be limited as described herein.

Figure 10:
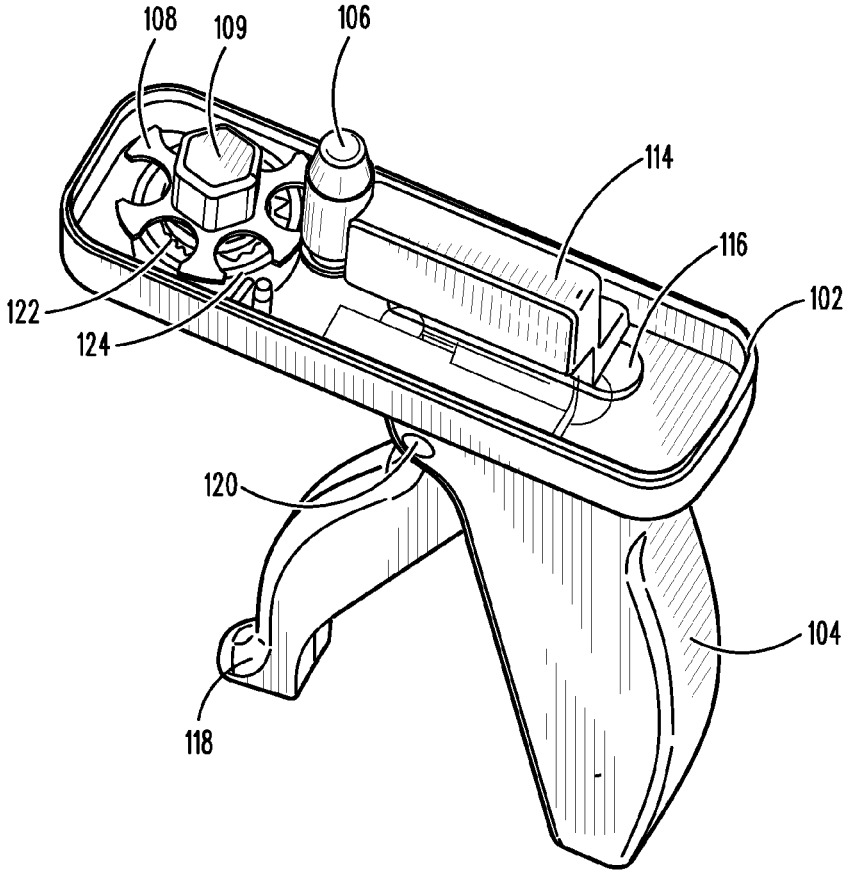
FIG. 10 illustrates a perspective view of a moonclip tool in an alternate embodiment of the present invention.

FIG. 10 illustrates a perspective view of an alternate moonclip tool 100. The moonclip tool 100 may comprise a base 102 and a handle 104 integrally connected to the base 102, forming, generally, an L-shaped apparatus for aiding in the loading of a round 106 onto a moonclip 108. The moonclip 108 sits upon an arbor 110 that may be shaped in such a manner to allow the moonclip 108 to rest a distance above the base 102, and in alignment with a groove 112 on the round 106. The moonclip tool 100 may further have an arm 114 disposed on a top surface 116 of the base 102 that may be linked to a trigger lever 118 that may be disposed within the handle 104, extending upwardly and linked with the arm 114. The trigger lever 118 may be pivoted at pivot point 120. A spring (not shown) may be disposed within handle 104, and may engage the trigger lever 118.

The moonclip tool 100 may further have a plurality of notches or teeth 122 disposed on the arbor 110 that may contact a brace 124. The notches or teeth 122 may be created in such a way that prevents rotation of the arbor 110 in a first direction and allows rotation of the arbor 110 in a second direction. For example, the notches or teeth 122 may be such that the brace 124 may contact a notch and prevent rotation in the first direction. As the arbor 110 rotates in the second direction, the notch may not engage the brace 124, and the brace 124 may allow rotation in that second direction.

Figure 11:
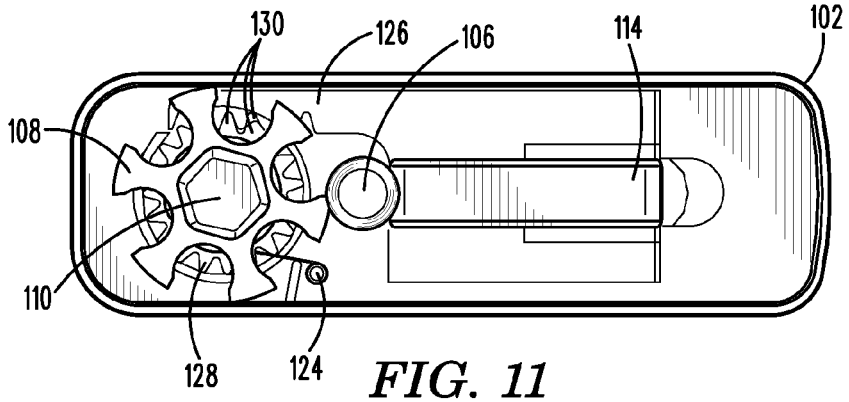
FIG. 11 illustrates a top view of a moonclip tool in an alternate embodiment of the present invention.

The arm 114 may further comprise a rack 126 as shown in FIG. 11. The rack 126 maybe connected to and move along with the arm 114. The rack 126 may extend within the base 102 and contact a gear 128 with a plurality of teeth 130. The gear 128 may contact the plurality of teeth 130 such that when the rack 126 moves linearly the gear 128 may move rotationally. The gear 128 may be below the arbor 110 and may rotate independent of the arbor 110 in the first direction when the brace 124 is preventing the arbor 110 from rotating in the first direction. The gear 128 may rotate in the second direction in conjunction with the arbor 110.

As shown in FIG. 10-11, the moonclip tool 100 may be used to load the round 106 into the moonclip 108. The round 106 may be placed in front of the arm 114 and the moonclip 108 may be placed on the arbor 110. The trigger lever 118 may be moved towards the handle 104, which, in turn, may move the arm 114 and the round 106 towards the moonclip 108. The rack 126 may move along with the arm 114 moving the plurality of teeth 130 linearly. As a result, the gear 128 may rotate in the first direction independent of the arbor 110, because the brace 124 may prevent the arbor 110 from rotating in the first direction. The round 106 may thus lock into the moonclip 108 at the groove 112.

The trigger lever 118 may then be moved away from the handle 104 via a biasing spring, or the like, which, in turn, may move the arm 114 away from the moonclip 108. The rack 126 may move along with the arm 114 moving the plurality of teeth 130 linearly. As a result, the gear 128 may rotate in the second direction in conjunction with the arbor 110, which may rotate the moonclip 108. As a result, the round 106 may be rotated away from the arm 114 and the moonclip 108 may be situated to present a berth for another round. A new round may be loaded in a similar manner as described above.

Figure 12:
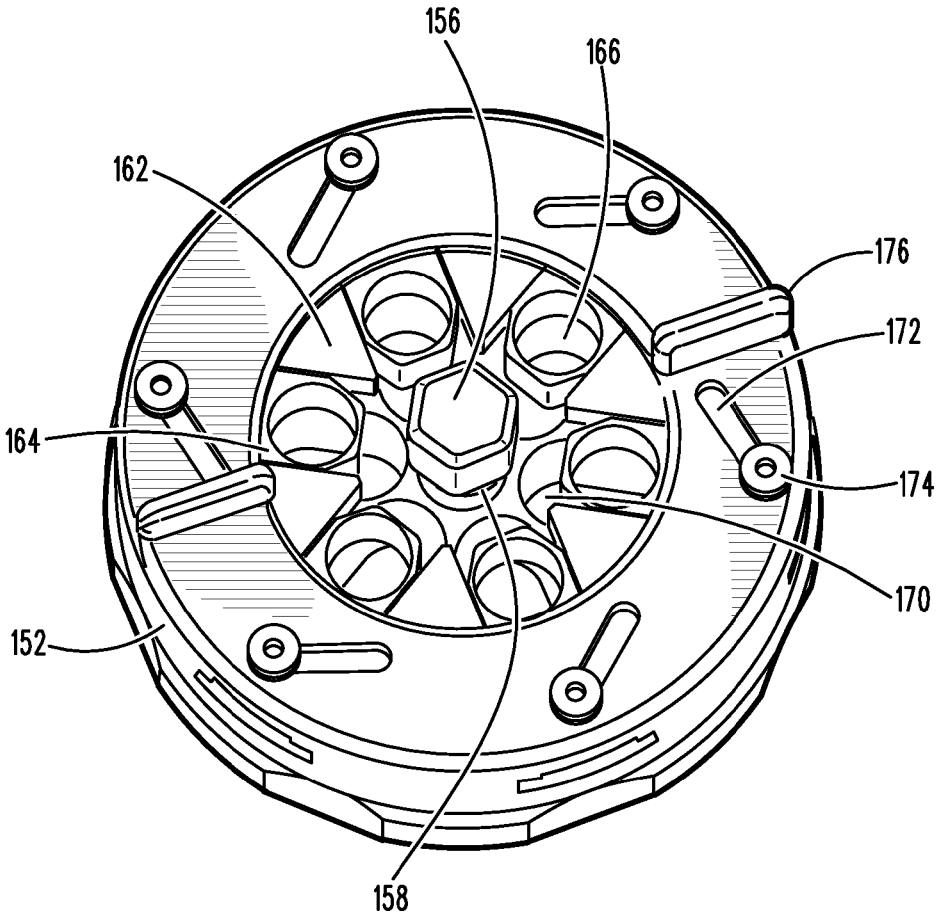
FIG. 12 illustrates a perspective view of a moonclip tool in an alternate embodiment of the present invention.
Figure 13:
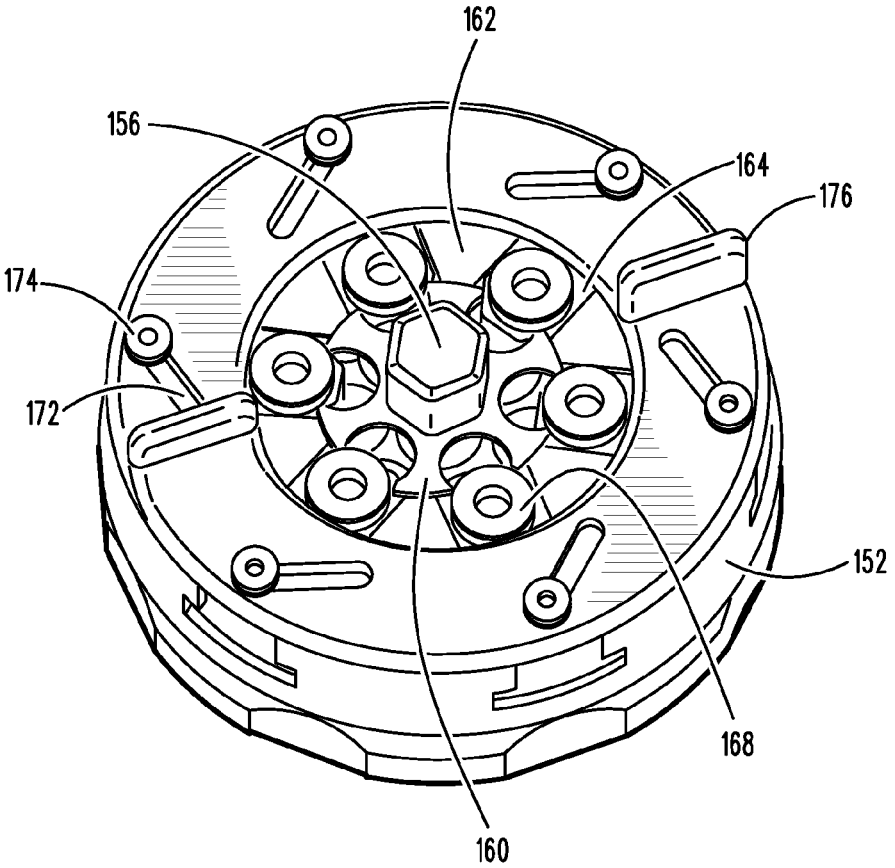
FIG. 13 illustrates a perspective view of a moonclip tool with multiple rounds in an alternate embodiment of the present invention.
Figure 14:
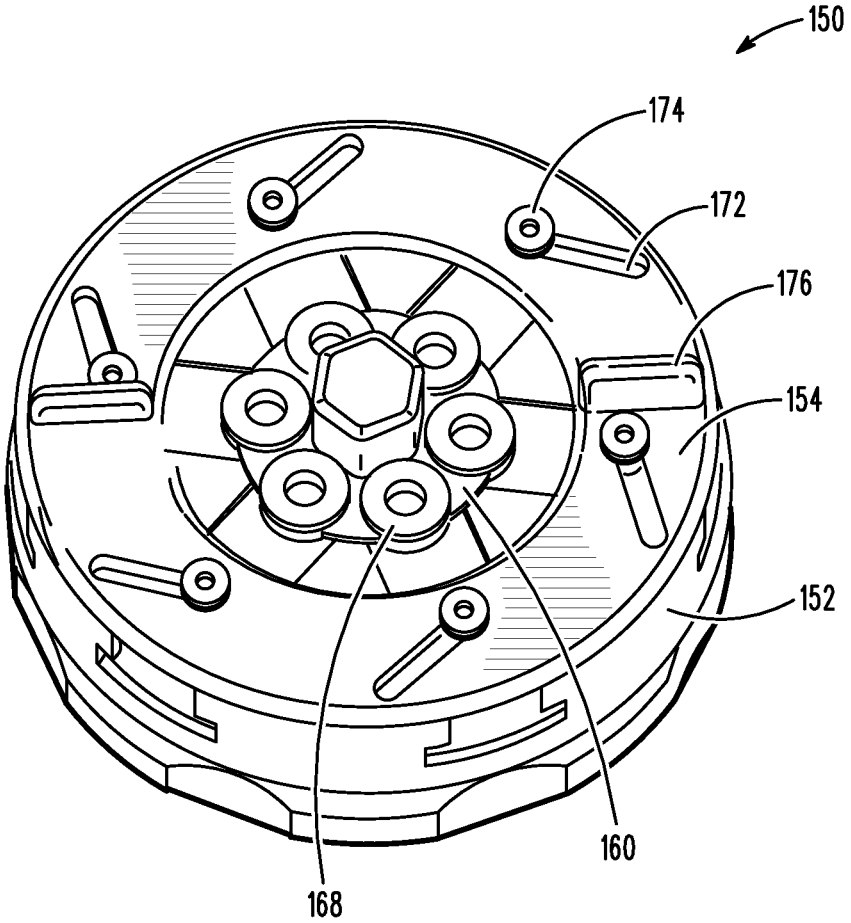
FIG. 14 illustrates a perspective view of a moonclip tool in operation pressing multiple rounds into a moonclip in an embodiment of the present invention.

FIGS. 12-14 illustrates an alternate moonclip tool 150. The moonclip tool 150 may be, generally, circular in shape and have a base 152 and a disc 154, wherein the disc 154 is disposed on top of the base 152. The moonclip tool 150 may have an arbor 156 in the center. The arbor 156 may have a lip 158 that may hold a moonclip 160, as shown in FIG. 13, in line with the top of the base 152. The moonclip 160 may also rest on top of a plurality of sections 162 disposed within the base 152. A plurality of arms 164 may be disposed between the plurality of sections 162, wherein each arm 164 may comprise a chamber 166 for holding a round 168, as shown in FIG. 13. Below each chamber 166 may be a slot 170 that may allow a round 168 to move therein. The disc 154 may be disposed on top of the sections 162 and the arms 164 and may rotate independently of the base 152, the sections 162, and the arms 164. The disc 154 may have a plurality of angled slots 172 corresponding to the plurality of arms 168. A plurality of bolts or pins 174 may be disposed within the angled slots 172 and may be attached to the plurality of arms 164. The disc 154 may further comprise a plurality of handles 176. The plurality of handles 176 may allow the disc 154 to be rotated by a user gripping the same and moving with his or her hands, as described below.

As shown in FIGS. 12-14, the moonclip tool 150 may be used to load the plurality of rounds 168 into the moonclip 160. The plurality of rounds 168 may be placed into the chambers 166 within the arms 164. The moonclip 160 may be placed on the arbor 156 with its ends resting on the sections 162. The disc 154 may be rotated, forcing the bolts or pins 174 to follow the angled slots 172. As the bolts or pins 174 follow the angled slots 172, the attached arms 164 may move inward linearly, forcing the rounds 168 into the moonclip 160. The moonclip 160 loaded with the rounds 168 may be removed by flipping the moonclip tool 150 upside-down. The moonclip tool 150 may then be rotated in the opposite direction in order to load another moonclip 160.

It should be noted that various changes and modifications to the presently preferred embodiments described herein will be apparent to those skilled in the art. Such changes and modifications may be made without departing from the spirit and scope of the present invention and without diminishing its attendant advantages.

We claim:

1. An apparatus for loading rounds into a moonclip, the apparatus comprising:

a base having a center, wherein the base comprises a plurality of slots running radially toward the center of the base wherein each of the slots comprises a movable arm configured to translate toward the center of the base within the respective slot, and further wherein each of the arms comprises a chamber configured to hold a round;

a rotatable top plate, wherein the rotatable top plate is disposed on top of the base;

an arbor configured to hold a moonclip, wherein the rotatable top plate is configured to translate the movable arms toward the center of the base such that a plurality of rounds held by the chambers in the arms are pushed into corresponding receiving slots in the moonclip.

2. The apparatus of claim 1 wherein a handle is disposed on the rotatable top plate.

3. The apparatus of claim 1 wherein the arms are engaged to the top plate by a plurality of bolts, wherein the bolts are disposed within a plurality of angled slots within the top plate.

4. The apparatus of claim 1 wherein the base is circular.

5. The apparatus of claim 1 wherein the moonclip is configured to fit snug on the arbor.

6. The apparatus of claim 1 further comprising:

a plurality of angled slots within the rotatable disc, wherein each of the arms comprises a pin extending from the respective arm and through one of the plurality of angled slots in the rotatable disc, wherein each of the pins are configured to travel through its respective angled slot when the rotatable disc is rotated, thereby moving the respective arm the pin extends from.

7. The apparatus of claim 1 wherein the top plate is a disc.

8. The apparatus of claim 1 wherein the top plate is a disc having an open area in the center thereof configured to allow one or more rounds to be disposed within the chambers in the arms.

* * * * *